US006440363B1

(12) United States Patent
Fukumoto

(10) Patent No.: US 6,440,363 B1
(45) Date of Patent: Aug. 27, 2002

(54) PROCESS FOR THE FUNGISTATIC AND/OR ANTIBACTERIAL FINISHING OF SEWINGS AND EQUIPMENT THEREFOR

(75) Inventor: Katsumori Fukumoto, Kainan (JP)

(73) Assignee: Fukusen Kogyo Co., Ltd., Wakayama (JP)

( * ) Notice: Subject to any disclaimer, the term of this patent is extended or adjusted under 35 U.S.C. 154(b) by 0 days.

(21) Appl. No.: 09/269,273

(22) PCT Filed: Aug. 5, 1998

(86) PCT No.: PCT/JP98/03527

§ 371 (c)(1),
(2), (4) Date: Mar. 25, 1999

(87) PCT Pub. No.: WO99/07932

PCT Pub. Date: Feb. 18, 1999

(30) Foreign Application Priority Data

Aug. 7, 1997 (JP) ..... 9-227299

(51) Int. Cl.[7] ..... A61L 2/00; A61L 9/00

(52) U.S. Cl. ..... 422/28; 422/8; 8/137; 8/142; 8/149.2; 38/143

(58) Field of Search ..... 422/8, 28; 424/104

(56) References Cited

U.S. PATENT DOCUMENTS 3,669,043 A * 6/1972 Nicolay ..... 112/76
4,922,567 A * 5/1990 Miller ..... 8/151
5,440,810 A * 8/1995 Borucki et al. ..... 38/143

FOREIGN PATENT DOCUMENTS

| | | |
|---|---|---|
| JP | 36 7666 | 4/1961 |
| JP | 63 35870 | 2/1988 |
| JP | 4108185 | 4/1992 |
| JP | 5 94295 | 12/1993 |
| JP | 3004442 | 9/1994 |
| JP | 7275589 | 10/1995 |

* cited by examiner

*Primary Examiner*—Robert J. Warden, Sr.
*Assistant Examiner*—Imad Soubra
(74) *Attorney, Agent, or Firm*—Birch, Stewart, Kolasch & Birch, LLP

(57) ABSTRACT

The fungistatic/antibacterial treatment method for sewed goods like clothes according to the present invention is characterized by the steps of permeating the fungistatic/antibacterial chemicals into a variety of sewed goods like clothes after sewed, to be adsorbed thereby, followed by draining, and then drying by heating them with hot air in the state of being hung from hangers. Thus since the sewed goods to which the fungistatic/antibacterial chemicals have been applied are dried in the state of being hung from hangers, positive fixed adsorption of the fungistatic/antibacterial chemicals can be made, foreclosing uneven permeation of the fungistatic/antibacterial chemicals, which is usually unavoidably brought about by their contact with other objects, whereby highly wash resistant fungistatic/antibacterial treatment has been realized.

2 Claims, 8 Drawing Sheets

Finishing step /Heat treatment step/Pre-drying step / Antibacterial application step 20
21
22
22a
22b
23
24
24a
25
30
30a
30b
31
32
32a
32b
33
34
34a
35
L1
L2
X

PROCESS FOR THE FUNGISTATIC AND/OR ANTIBACTERIAL FINISHING OF SEWINGS AND EQUIPMENT THEREFOR

This application is the national phase under 35 U.S.C. § 371 of PCT International Application No. PCT/JP98/03527 which has an International filing date of Aug. 5, 1998, which designated the United States of America.

TECHNICAL FIELD

The invention of this application relates to a method of fungistatic/antibacterial treatment particularly suitable for sewed goods like clothes.

BACKGROUND ART

Heretofore, for making fungistatic/antibacterial treatment uniformly on textures of clothes, clothes have been sewed, employing textures woven with yarns subjected to fungistatic/antibacterial treatment or textures subjected to such a treatment.

In whichever case, since the fungistatic/antibacterial treatment is to be performed before the texture is sewed, this treatment is not made at all on such addenda as sewing thread, woven label tape, fastener, button and button hole or the like which are attached to the clothes. Even such addenda include trousers' fastener, which is situated in a position nearest to the private parts, where the fungistatic/antibacterial treatment is required more than the other locations.

In recent years, attempts have been made to remedy the present situation, and for the fungistatic/antibacterial treatment to cover every corner of clothes, there have been being proposed procedures to make the fungistatic/antibacterial treatment after the clothes have been sewed. Proposed, for example, has been a fungistatic/antibacterial treatment process which comprises loading sewed clothes on a belt conveyer, to move them successively, applying fungistatic/antibacterial agents on the clothes by spraying the fungistatic/antibacterial chemicals on them from spray nozzles installed midway in the conveying course, and thereafter, drying the clothes on the conveyer by blowing hot air in a drying apparatus installed beyond the conveyer stand, thereby accomplishing the operation.

For the aforementioned conveyer, netted one should be used for draining the water content attributable to the chemicals or the moistening done for their permeation.

Despite such ingenious measures taken, it was difficult to get the fungistatic/antibacterial chemicals firmly stuck on the completely sewed clothes readily and evenly. This was because even a netted conveyer prevents the sprayed fungistatic/antibacterial chemicals from properly and appropriately permeating into every corners of the clothes due to the contact of these parts with the conveyer, or conversely their contact with the conveyer makes it difficult to let oversticking chemicals drip off to drain.

On this account, when it was intended to cover such an addendum as a fastener by a single fungistatic/antibacterial treatment once and for all, to meet the request for performing such a treatment on large quantity of sewed clothes, it couldn't be helped but to tolerate some uneven application of the chemicals.

Besides, because of the difficulty getting the fungistatic/antibacterial chemicals positively and firmly stuck to clothes, the chemicals tend to be removed by sweating or several times washing, This disadvantage must also be tolerated as inevitable.

Where the woven label tape only is concerned, the name is stitched or printed on a plurality of tape segments, to produce the label tape of this kind. Such a long label tape could not be efficiently treated, resulting in difficulty applying adequate fungistatic/antibacterial treatment with high washability. If treated tape is stitched or printed, result is untreated thread or ink left in the cloth.

This situation is not only undesirable with sewed goods like common clothes, but with those for medical uses which involve such grave issues as hospital infection, etc.

Particularly, the bacterial hospital infection called MRSA is caused by methicillin resistant staphylococcus aureus. Persons administered antibiotics, post-operation patients, and the aged or children who have weak immunity tend to contract infectious diseases. Once they are infected by the aforementioned bacteria, antibiotics will lose their effectuality, and no therapeutic remedy will be found. The infection route is such that the pathogenic bacteria directly infiltrate into the body through damaged parts of mucous membrane or skin. Such an infiltration of pathogenic bacteria causes infectious diseases of dermal soft tissues such as hidradenitis suppurativa, perirectal abscess, lymphadenitis and purulentdenitis, etc. If this infection reaches to deep locations, it will bring about purulent arthritis or medullary disease, which lead to sepsis or infectious disease endcarditis as post-operation respiratory or urinary tract or systemic infectious disease, which may invite hard-to-cure contagious diseases which may cause death. Accordingly, such hospital infections will pose as an unoverlookable dreadful issue.

Thus the present invention is intended to provide a means to permit fungistatic/antibacterial agents to be firmly stuck evenly and positively on sewed clothes to undergo the fungistatic/antibacterial treatment, for resolution of the aforementioned problems.

DISCLOSURE OF THE INVENTION

A first invention of this application provides a method of fungistatic/antibacterial treatment of sewed goods characterized by the steps of applying fungistatic/antibacterial chemicals on sewed goods such as clothes, etc. by getting the fungistatic/antibacterial chemicals deposited on or permeated into the sewed goods, and thereafter heating this sewed goods in the state of being arranged in the air, thereby firmly setting the fungistatic/antibacterial chemicals in place on and in the sewed goods. Since in the first invention of this application, the sewed goods with the fungistatic/antibacterial chemicals applied are dried in the state of being arranged in the air, uneven permeation of fungistatic/antibacterial chemicals which usually results from contacts with external objects after application of fungistatic/antibacterial chemicals and before drying the sewed goods may be precluded.

A second invention of this application provides the method of fungistatic/antibacterial treatment of sewed goods of the aforementioned first invention wherein the process of applying the fungistatic/antibacterial chemicals is characterized by the steps comprising a primary dipping of dipping the sewed goods in the fungistatic/antibacterial chemicals, a primary extraction for draining the sewed goods subjected to the primary dipping, a secondary dipping of again dipping in the fungistatic/antibacterial chemicals the sewed goods subjected to the primary extraction and a secondary extraction for draining the sewed goods subjected to the secondary dipping. The second invention of this application can assure positive and uniform deposition of the fungistatic/antibacterial chemicals on the sewed goods, thereby precluding loss of the fungistatic/antibacterial effect which otherwise is unavoidably caused by frequent washing.

A third invention of this application provides the method of fungistatic/antibacterial treatment of sewed goods of either the aforementioned first or second invention, wherein the heating process is characterized in that the sewed goods are heated by transferring the sewed goods in a heater housing in the state of being hung from hangers which are supported by a conveyer member circulating at least through the heater housing, said hanger comprising a central portion provided with a hook and right and left arms extending to right and left from this central portion, with a means for opening/closing the right and left arms provided at the central portion, such that when hanging the sewed goods on the hanger, the right and left arms are closed, and put into the sewed goods, and thereafter they are opened, to hang it in their open state. According to this third invention, the opening/closing of the arms of the hanger permits efficient hanging and removal of clothes, thereby affording improved efficiency of the treatment process.

A fourth invention of this application provides the treatment method of sewed goods according to either one of respective inventions mentioned above, wherein the heating process is characterized by the steps comprising low temperature heating and high temperature heating done at higher temperatures than the former, with the sewed goods heated while being continuously moved from a low temperature through a high temperature heater housing. By conducting the heating in two steps in this manner, favorable drying by heating is realized, with enhanced fixed adsorption of the fungistatic/antibacterial chemicals.

A fifth invention of this application provides the method of fungistatic/antibacterial treatment of sewed goods according to either one of the aforementioned first, second or fourth invention, characterized in that the sewed goods is a long strip such as a woven label tape on which one or more names is or are stitched or printed in series, and that this long strip is transferred in the state of being arranged extending in the air space of the heater housings. With regard to intermediate products like woven label tape, the treatment may be performed more efficiently in this way than separately treating the cloth tape and the thread for stitching the name.

A sixth invention of this application provides the fungistatic/antibacterial treatment method of the sewed goods according to the aforementioned fifth invention characterized in that in the heating process, a support for long strips for movably supporting long strips is moved while being held by a conveyer member arranged at least in the heater housing; the transfer by means of the conveyer member of the support for long strips in the state of being arranged in the heater housing at adequate intervals is stalled, and then the long strips are held on the stalling support for long strips, thereafter letting the long strips move in the state of being arranged in the air space of the heater housing. This invention permits the long strip to be efficiently arranged in place by means of the conveyer member, so that the change-over of process from usual clothes to long strips may be readily made, merely using the support for long strips in place of hangers.

A seventh invention of this application provides the treatment method of sewed goods according to either one of the aforementioned first, second or fourth invention, characterized in that the sewed goods are long strips each of a label tape having a woven label or a series of woven labels, etc. The seventh invention of this application permits the fungistatic/antibacterial treatment to be made efficiently rather than separately subjecting the cloth tape and the name stitching thread or the printing ink to the fungistatic/antibacterial treatment, when handling such an intermediate product as woven label, etc.

An eighth invention provides an installation for the fungistatic/antibacterial treatment of sewed goods comprising a means for applying the fungistatic/antibacterial chemicals on the sewed goods such as sewed clothes, etc. by depositing or permeating the fungistatic/antibacterial chemicals thereon or thereinto and a heating treatment means for heating the sewed goods endowed with the fungistatic/antibacterial chemicals in the state of being arranged in the air space. According to the eighth invention of this application, the drying of the sewed goods endowed with the fungistatic/antibacterial chemicals is performed in the state of them being arranged in the space. This has made it possible to provide an installation for the fungistatic/antibacterial treatment capable of precluding uneven permeation of the fungistatic/antibacterial chemicals which usually arises from the contacts of the sewed goods with external bodies before drying after application of the fungistatic/antibacterial chemicals.

BRIEF DESCRIPTION OF DRAWINGS

FIG. 3(B), a schematic side view of a high temperature heating unit of this heating apparatus.

BEST MODE FOR CARRYING OUT THE INVENTION

Embodiments of the invention will be described in reference to the accompanying drawings.

Figure 1:
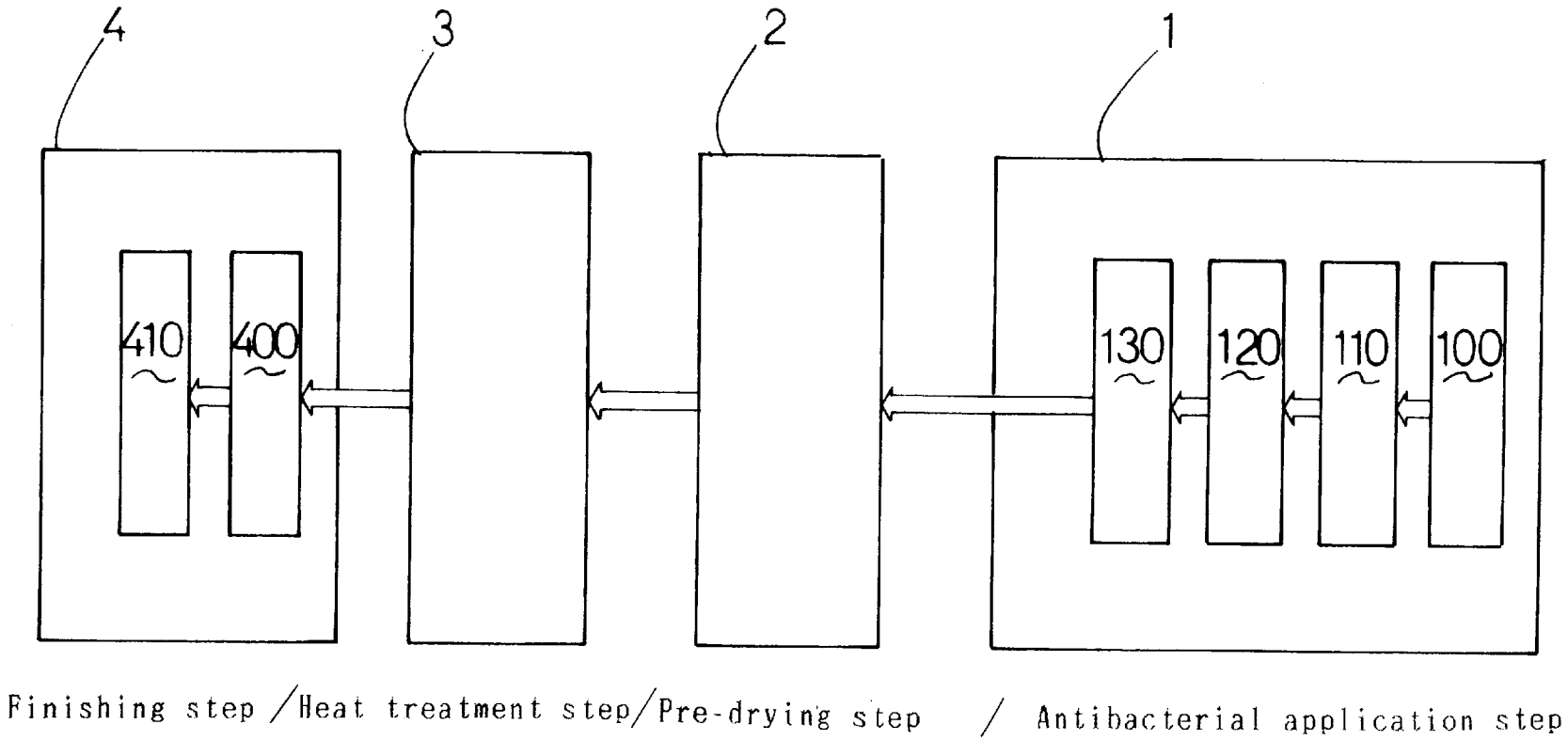
FIG. 1 is a block diagram showing an embodiment of the method according to the present invention.
Figure 2:
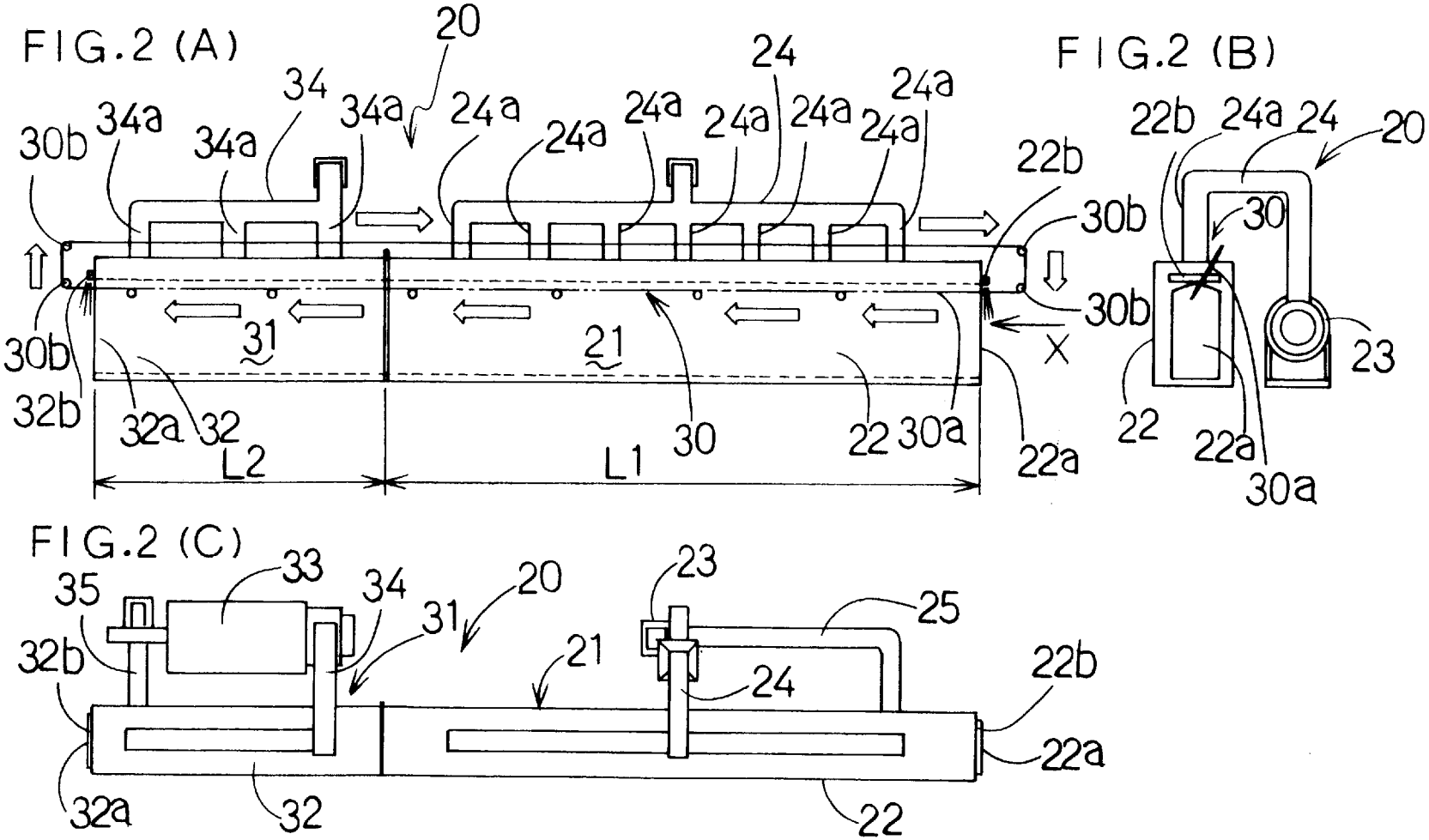
FIG. 2(A) is a schematic side view of a heating apparatus according to the present invention.
FIG. 2(B), a schematic front view of this heating apparatus.
FIG. 2(C), a schematic plan view of this heating apparatus.

Referring to FIGS. 1 and 2, first embodiment of the invention of this application is described. FIG. 1 is a block diagram showing the treating method according to this embodiment; FIG. 2(A), a schematic side view of a heating apparatus for use in the low and high temperature heating steps; FIG. 2(B), a schematic front view of the apparatus shown in FIG. 2(A); and FIG. 2(C),a schematic plan view of the apparatus shown in FIG. 2(A).

The fungistatic/antibacterial treatment method according to the invention of this application is characterized by the steps of applying by permeation the fungistatic/antibacterial chemicals into the sewed goods like sewed clothes, etc, followed by draining, and then drying them by heating with hot air in their state of being arranged in the air space, as by hanging from hangers and so forth. It is to note that the fungistatic/antibacterial treatment method is acceptable only if it can afford prevention of propagation of germs, whatever it is called, either fungistatic or antibacterial process. In the following, an embodiment of the fungistatic/antibacterial treatment method according to the present invention will be definitely described:

First according to this fungistatic/antibacterial treatment method, as shown in FIG. 1, treatments comprising a fungistatic/antibacterial chemicals applying step 1, low and high temperature heating steps 2 and 3, and finishing step 4 are carried out on sewed clothes in the order mentioned.

The fungistatic/antibacterial chemicals applying step 1 comprises primary dipping 100 and primary extraction 110 performed after this primary dipping 100, and secondary dipping 120 performed after the primary extraction 110 and secondary extraction 130 performed after this secondary dipping 120.

The aforementioned primary dipping is a process in which the aforementioned clothes are thrown into a dipping tank filled with the fungistatic/antibacterial chemicals (solution), thereby getting the fungistatic/antibacterial chemicals permeated into the clothes.

The primary extraction 110 is a process of draining by separating by an separator excess solution from the clothes taken out of the aforementioned dipping tank.

This separator is an apparatus of a construction similar to that of the hydro-extractor of the well-known home washer, namely an apparatus (not shown in the drawing) comprising a tank for accommodating the clothes and a mechanism so constructed as to effect draining by turning this tank. The primary extraction 110 is a work of extracting by such means excess fungistatic/antibacterial chemicals permeated into the clothes.

The primary extraction 110 removes excess fungistatic/antibacterial chemicals that have permeated the clothes, and the powerful extraction of the clothes by the aforementioned method promotes adhesion of the fungistatic/antibacterial chemicals to the fiber.

The aforementioned secondary dipping 120 is a process in which the clothes that have undergone the primary extraction are thrown into a dipping tank filled with the fungistatic/antibacterial chemicals, to be dipped therein, thereby letting the solution permeate the clothes.

The secondary extraction 130 is a process of separating excess solution from the clothes that have been taken out of the dipping tank after the secondary dipping.

The secondary extraction 130 is performed in similar manner as the aforementioned primary extraction.

The secondary extraction 130 finally removes excess fungistatic/antibacterial chemicals from the clothes which the fungistatic/antibacterial chemicals have permeated. The powerful extraction of clothes by the aforementioned method at the secondary extraction 130 promotes further strong adhesion of the fungistatic/antibacterial chemicals to the fibers. Thus this secondary extraction has the effect of maintaining quite favorable state of adhesion of the fungistatic/antibacterial chemicals to the fibers, even when the treated clothes are washed.

The secondary extraction should desirably be performed in such a way that the clothes will have about twice as heavy weight as they had before undergoing the fungistatic/antibacterial chemicals application step.

As described in the foregoing, under this embodiment the draining is performed by such extraction steps as the aforementioned primary and secondary extraction steps 110 and 130.

For the fungistatic/antibacterial chemicals solution used in the primary and secondary dipping steps 100 and 120 of the aforementioned fungistatic/antibacterial chemicals applying process 1, use is made of phenyl amide base fungistatic/antibacterial chemicals, for example, "AMORDEN MCM-400" (trade name) manufactured by Daiwa Chemical Industries Co., Ltd. or composite cation base antibacterial agents, for example, "AMORDEN CHI-500" (trade name) manufactured by the same company. The former "AMORDEN MCM-400" is a popular chemical, but the latter "AMORDEN CHI-500" is a therapeutic drug. In correspondence with the applications of the treatments, selected are appropriate fungistatic/antibacterial chemicals. It is improper, however, to mix the "AMORDEN MCM-400" and the "AMORDEN CHI-500". They should desirably be used independently.

Particularly, the aforementioned therapeutic drugs provide fibers with washability persistency and MRSA inhibiting effect. Accordingly, applying the invention of this application, using such drugs, to operation gown, underwear or nightclothes will afford providing long lasting effect of inhibiting hospital infection, and furthermore will be effective for suppressing propagation of such pathogens as *staphylococcus aureus, coli, pneumobacillus, Pseudomonus aeruginosa* (which invites bedsore or diaper rash), *bacillus subtilis* (which causes conunctivitis) and pneumococccus (which causes pneumonia), etc., thus making for prevention of infection and effectual countermeasure against MRSA bacillus at hospitals or homes for the aged.

When using chemicals other than the aforementioned, it is desirable to use those having the washability persistency and MRSA inhibiting action, as applied on fibers, from the aforementioned perspective.

The aforementioned popular chemicals have fungistatic, antibacterial and odor-proof effects. Normally, bacteria living on apparels or skins propagate with sweat and soils as their nutrient sources. When they are propagating, decomposed products from the aforementioned nutrient sources produce "repugnant smell". The aforementioned popular chemicals suppress their growth, forestalling generation of such odors. These popular chemicals also inhibit breeding on fibers of such pathogens as coli, Pseudomonus aeruginosa and bacillus subtilis, etc. Accordingly, when using even the popular chemicals other then those above-mentioned, they should desirably be chosen from those having the fungistatic, antibacterial as well as deodorization effects.

Further, in place of the chemicals above-mentioned, chemicals of chitosan derivatives as their main components, e.g., "UNIKA CM-117" (trade name) manufactured by Union Chemical Industries Co., Ltd. may be usable.

Furthermore, it is also practical to employ chemicals other than those mentioned above.

The low and high temperature heating steps 2 and 3, respectively, are heating treatment processes performed on the clothes which have undergone the aforementioned chemicals applying step 1.

FIG. 2 illustrates a heating apparatus 20 used in taking the low and high temperature heating steps 2 and 3.

Referring to FIGS. 2(A) and (C), the heating apparatus 20 comprises a low temperature heating unit 21 for performing the low temperature heating step 2, a high temperature heating unit 31 for performing the high temperature heating step 3, and a conveyer arrangement 30 installed inside the low and high temperature heating units 21 and 31.

The low temperature heating unit 21 comprises a low temperature heater housing 22 with its interior forming clothes transfer path, steam heater 23 provided separately from the low temperature heater housing 22, introduction pipe 24 (FIGS. 2(A), (B) and (C)) interposed between the steam heater 23 and the upper part of the low temperature heater housing 22, to communicate therebetween, and discharge pipe 25 (FIG. 2(C)) similarly interposed between the steam heater 23 and the bottom side of the low temperature heater housing 22, to communicate therebetween.

The low temperature heater housing 22 is a housing having a lateral width of about 12.4 meters and a height of about 2.5 meters.

The steam heater 23, which is capable of generating about 30 thousand kcal per hour, feeds this hot air to the low temperature heater housing 22 through the introduction pipe 24. The introduction pipe 24, as shown in FIG. 2(A), branches into a plurality of branch pipes 24*a* . . . 24*a* on the low temperature heater housing 22. These branch pipes 24*a* . . . 24*a* are respectively connected to the upper part of the low temperature heater housing 22, therethrough to introduce the aforementioned hot air into the low temperature heater housing 22.

Then the hot air introduced into the low temperature heater housing 22 is discharged therefrom toward the steam heater 23 through the discharge pipe 25.

As shown in FIG. 2(B), at the front of the low temperature heater housing 22 is there formed an entrance 22*a* for introducing the clothes into the low temperature heater housing 22. At the upper part of this entrance 22*a* is there provided an air nozzle 22*b*. The air nozzle 22*b* ejects air downward, to form an air curtain, thereby closing the entrance 22*a*. By this air curtain, is the interior of the low temperature heater housing 22 shut off from ambient air.

The high temperature heating unit 31 comprises a high temperature heater housing 32 installed at the rear of the low temperature heater housing 22 of the low temperature heating unit 21, extending therefrom and forming a clothes transfer path in its interior, air heater 33 provided separately from the high temperature heater housing 32, introducing pipe 34 interposed between the air heater 33 and the upper part of the high temperature heater housing 32, to communicate therebetween, and discharge pipe 35 similarly interposed between the air heater 33 and the lower side of the high temperature heater housing 32(FIG. 2(C)).

The high temperature heater housing 32 is formed integrally with the low temperature heater housing 22, and has a lateral width L2 of about 6.2 meters. The high temperature heater housing 32 has a height equal to that of the low temperature heater housing 22.

The air heater 33 is capable of generating a 200° C. hot air, harnessing kerosene as the fuel, to feed the generated hot air into the high temperature heater housing 32 through the introducing pipe 34. The introducing pipe 34 is branched into branch pipes 34*a* . . . 34*a*. These branch pipes 34*a* . . . 34*a* are respectively connected to the upper part of the high temperature heater housing 32, to introduce the aforementioned hot air into the high temperature heater housing 32 through the branch pipes 34*a* . . . 34*a*.

The hot air introduced into the high temperature heater housing 32 is discharged from the high temperature heater housing 32 toward the air heater 33 through the discharge pipe 35.

As shown in FIG. 2(C), at the back of the high temperature heater housing 32 is there formed an exit 32*a* for carrying the clothes out of the chamber 32. At the upper part of this exit 32*a*, is there installed an air nozzle 32*b*. The air nozzle 32*b* ejects air downward, to form an air curtain, thereby closing the exit 32*a*. By this air curtain, the interior of the high temperature heater housing 32 is shut off from the ambient air.

Next, the conveyer arrangement 30 comprises a conveyer chain 30*a* which is capable of slinging a plurality of hangers and a holder/drive 30*b* for circulating the conveyer chain 30*a*.

The holder/drive 30*b* circulates the conveyer chain 30*a*, while holding it. The conveyer chain 30*a*, which is formed in a ring configuration, enters into the low temperature heater housing 22 from its entrance 22*a*, goes out of the high temperature heater housing 32 through its exit 32*a*, and then again returns to the entrance 22*a* of the low temperature heater housing 22, following a route upward of both housings 22 and 32. Thus the conveyer chain 30*a* circulates along this path.

A rod shape screw for transfer may be used in place of this conveyer chain 30*a*. This rod shape screw for transfer has a thread formed on its periphery, so that the hangers may be forwarded by its turning in the normal direction, and reversed by its turning in the reverse direction. It should be noted that every conveyer chain discussed hereinafter may be replaced by the rod shape screw for transfer, or both types may be used in combination.

The clothes which have undergone the chemicals applying step 1 are successively hung from the hangers, which are then slung from the conveyer chain 30*a* just in front of the entrance 22*a* of the low temperature heater housing 22 of the heating unit 20.

The clothes hung from the hangers which are in turn slung from the conveyer chain 30*a* go ahead through the interior of the low and the high temperature heater housings 22 and 32 in the forwarding direction X. While the hangers used for slinging clothes may be appropriately selected based on their material and with the withstandability to the heating temperatures as a requirement, those made of stainless steel are preferable. With regard to the shape of the hanger, any one commonly used in household or cleaning shops may be utilized in implementing the invention.

The low temperature heating step 2 is a process of drying by heating the clothes being hung from hangers which are led by the conveyer chain 30*a* to traverse the interior of the aforementioned low temperature heater housing 22. The interior the low temperature heater housing 22 heats the aforementioned clothes at a low temperature between about 70 and 80° C. (the temperature inside the low temperature heater housing 22) by blowing the hot air from the previously stated steam heater 23. The clothes hung from the hangers, after moving through the inside of the low temperature heater housing 22, taking around 10 minutes, travels into the high temperature heater housing 32. The aforementioned heating temperature and time may be altered in correspondence with the quality, etc. of the clothes, the objects of the treatments.

The high temperature heating step 3 is a process of drying by heating with a hot air the aforementioned clothes which have traveled from the low temperature heater housing 22, and which are then led by a conveyer chain 30*a* to further traverse the inside of the high temperature heater housing 32.

In the interior of the high temperature heater housing 32, the aforementioned clothes are dried by heating with the hot air from the air heater 33, as previously described, at a temperature normally between about 120 and 180° C. (the temperature inside the high temperature heater housing 32) for about 2 to 8 minutes. Thus the clothes hung from the hangers, after having been transferred inside the high temperature heater housing 32 held at the aforementioned temperature, taking around 2 to 8 minutes, are transported to the outside through the exit 32*a*. In this step also, the heating temperature and time may be altered corresponding to the quality of the clothes, the object of the treatments.

As described herein above, particularly in order to enhance the rate of adsorption of the fungistatic/antibacterial chemicals to fibers of clothes, it is desirable to conduct the hot air heating at about 120 to 180° C. for about 2 to 8 minutes in the high temperature heating step 3.

The aforementioned two drying steps 2 and 3, in which the clothes move inside the heating apparatus 20 in the state of being slung from hangers, permit their overall surfaces to be exposed to the hot air, and on the other hand excess fungistatic/antibacterial chemicals solution to drip downward uniformly. Accordingly, the clothes are dried without irregularly adsorbing fungistatic/antibacterial chemicals. Further, no irregular fixed adsorption of the fungistatic/antibacterial chemicals solution will occur on the clothes surfaces contacting external objects, that is usually unavoidable, thus assuring uniform adsorption of the fungistatic/antibacterial chemicals to the clothes.

The finishing step 4 comprises de-wrinkling 400 and packaging 410 which is performed after the de-wrinkling.

The aforementioned de-wrinkling is a process of taking off the conveyer chain 30*a* the clothes which have undergone the aforementioned low and high temperature heating steps 2 and 3, respectively, and smoothing out the wrinkles with use of a steam iron.

The packaging 410 is a process of folding the clothes, to contain them in a bag, or again hanging them from hangers.

By going through this finishing step 4, all the steps of the fungistatic/antibacterial treatment are accomplished.

Under this embodiment, particularly, after the excess fungistatic/antibacterial chemicals have been extracted from the clothes by the secondary extraction 130, they will have a weight twice as large as that before the fungistatic/antibacterial chemicals had been applied, and also the rate of adsorption of the fungistatic/antibacterial chemicals was notably enhanced by performing the high temperature heating step 3, after making low temperature heating in the low temperature heating step 2. In particular, it was confirmed by the tests and inspections conducted by the Japan Spinners Inspection Council that even after washing newly bought clothes more than 100 times, adequate amount of the fungistatic/antibacterial chemicals to ensure the fungistatic/antibacterial effect is left unremoved from the fibers.

Further, in conjunction with the aforementioned procedure, drying the clothes in the state of being slung from hangers enables uniform enhancement of the rate of fixed adsorption of the fungistatic/antibacterial chemicals to the treated clothes.

While under the aforementioned embodiment of the invention, the fungistatic/antibacterial chemicals are applied onto the clothes by directly dipping the clothes into the fungistatic/antibacterial chemicals solution, they may be applied onto them by spraying. However, employing the procedure of extracting after dipping, as in the above-described embodiment, will provide notably higher rate of adsorption than employing the method of spraying as above-mentioned.

Thus in this connection, the formerly-described embodiment of extracting after dipping is preferable to the latter.

Moreover, the chemicals to be applied onto the clothes are not limited to those having fungistatic/antibacterial property or properties only, but any chemicals that will provide a variety of effects such as, for example, hydraulic jump and water repellency, insectisidal effect, flame proofing, aromaticity, antistatic effect and configurational stability, etc. may be jointly used.

With regard to the primary and secondary extraction 110 and 130 in the chemicals applying step 1, using a device for wringing the clothes by passing them between two juxtaposed rollers, in place of the previously described apparatus is practical in exercising the invention (not shown in the drawings).

Furthermore, while the descriptions have been made with clothes as the object of treatment, the invention may be exercised with any sewed stuffs even other than clothes.

It is applicable, for example, to towel, sheet or other beddings, handkerchief, scarf, car sheet, pillow cover, table cloth, kitchen cloth, and in addition, hat or cap, cloth shoes, cloth bag, underwear, white robe, operating gown, nursing coveralls, nightclothes, rain gears like raincoat and bath robe, etc.

Besides, the invention is operative with labels having names stitched or printed on cloth as the objects, and further with long label tape having names stitched or printed, etc. on a cloth tape or a woven label tape having a series of woven labels.

In the case of such labels or labeled tape, etc., with regard to the aforementioned hangers for slinging clothes therefrom, it should preferably be operated with one provided with a clip like member for slinging the labels or labeled tape, etc. by pinching its ends with it.

Figure 3:
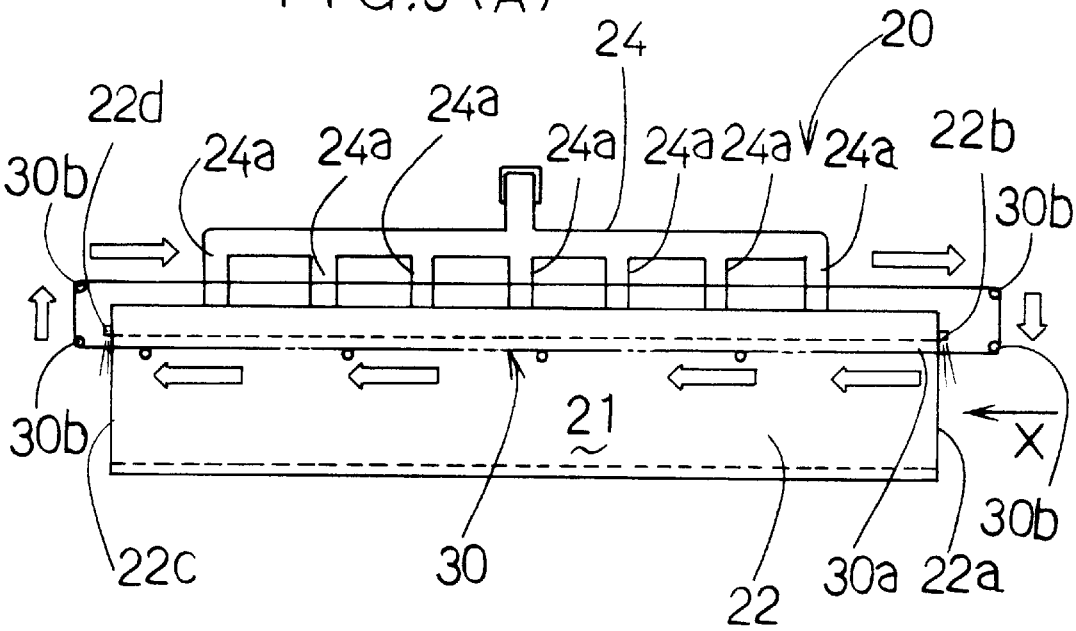
FIG. 3 (A) is a schematic side view of a low temperature heating unit of the heating apparatus covered by another embodiment.
Figure 3:
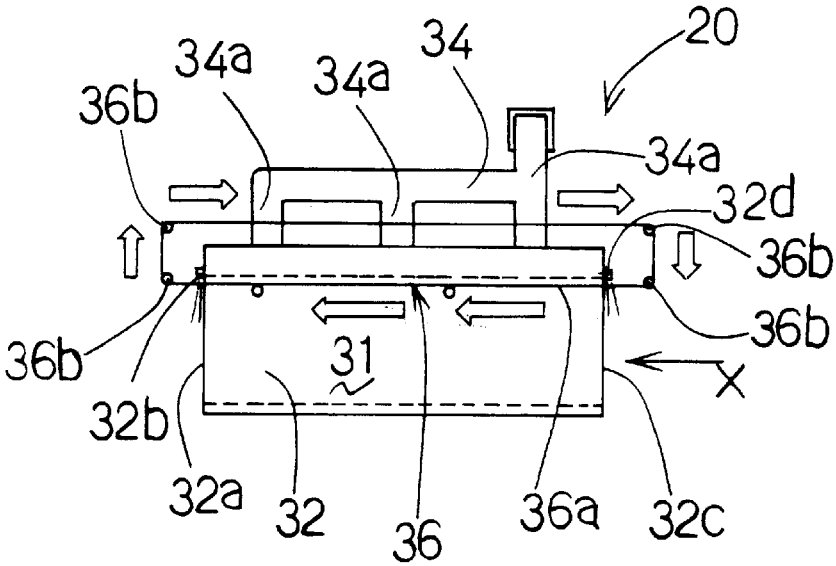

Another embodiment other than the one with the aforementioned heating apparatus 20 will be described in reference to FIG. 3. FIG. 3A shows a schematic side view of the low temperature heating unit 21 of this heating apparatus 20; and FIG. 3B, a schematic side view of its high temperature heating unit 31.

This heating apparatus 20, unlike the one given in FIG. 2, has the low and high heating units 21 and 31 separately formed.

As shown in FIG. 3(A), the heater housing 22 of the low temperature heating unit 21 has a rear portion provided with an exit 22*c*. At the upper part of this exit 22*c*, is there installed an air nozzle 22*d* for shutting off the inside of the housing 22 from ambient air with an air curtain. The low temperature heating unit 21 is equipped with a similar conveyer arrangement 30 to that of FIG. 2. Thus the conveyer arrangement 30 comprises a conveyer chain 30*a* capable of slinging a plurality of hangers and a holder/drive 30*b* for circulating the conveyer chain 30*a*. The holder/drive 30*b* circulates the conveyer chain 30*a*, while holding it. The conveyer chain 30*a* of the conveyer arrangement 30, which is formed in a ring shape, enters into the heater housing 22 through its entrance 22*a*, goes out to the outside through the aforementioned exit 22*c*, and then returns to the entrance 22*a* of the heater housing 22, following a route upward of the heater housing 22. Thus the conveyer chain 30*a* circulates along such a path.

This low temperature heating unit 21 is different from the low temperature heating unit 21 shown in FIG. 2 in that it is formed separately from the high temperature heating unit 31, as above described; that the heater housing 22 of the low temperature heating unit 21 has its rear portion provided with an exit 22*c* and an air nozzle 22*d*; and that the conveyer chain 30*a* circulates inside the heater housing 22 of the low temperature heating unit 21 only. However, except for this configuration, the low temperature heating unit 21 is identical to the low temperature heating unit 21 given in FIG. 2.

FIG. 3(B) shows the high temperature heating unit 31 formed separately from the aforementioned low temperature heating unit 21. As shown in FIG. 3(B), the heater housing 32 of the high temperature heating unit 31 has its front portion provided with an entrance 32*c*. At the upper part of this entrance 32*c*, is there provided an air nozzle 32*d* for shutting off the interior of the housing 32 from the ambient air by means of an air curtain.

Besides, this high temperature heating unit 31 is equipped with a conveyer arrangement 36 separate from the conveyer arrangement 30 provided for the aforementioned low temperature heating unit 21. This conveyer arrangement 36 comprises, like the conveyer arrangement 30 provided for the low temperature heating unit 21, a conveyer chain 36*a* capable of slinging a plurality of hangers and a holder/drive 36*b* for circulating the conveyer chain 36*a*. The holder/drive 36*b* circulates the conveyer chain 36*a*, while holding it. The conveyer chain 36*a* of the conveyer arrangement 36, which is formed in a ring form, enters into the heater housing 32 through the entrance 32*c* of the heater housing 32, goes out of the housing through the aforementioned exit 32*a*, and returns to the entrance 32*c* of the heater housing 32. Thus the conveyer chain 36*a* circulates along such a path.

This high temperature heating unit 31 is different from the high temperature heating unit 31 shown in FIG. 2 in that as described herein above, it is formed separately from the low temperature heating unit 21, the heater housing 32 of the high temperature heating unit 31 has a front portion provided with the entrance 32*c* and the air nozzle 32*d*, and separately equipped with the conveyer arrangement 36 having the conveyer chain 36*a* which is circulated only through the heater housing 32 of the high temperature heating unit 31. However, except for this configuration, the high temperature heating unit 31 shown in FIG. 3(A) is identical to the high temperature heating unit 31 shown in FIG. 2.

The clothes hangers that have come out of the low temperature heating unit 21 are once taken off the conveyer chain 30*a*, and after carried to the high temperature heating unit 31, are hung from its conveyer chain 36*a*.

By employing the heating apparatus 20 comprising the low and high temperature heater units 21 and 32 separately formed, space saving may be achieved. Particularly, in the case of the heating apparatus 20, since the low and high temperature heating units 21 and 31 are unitary, a linear space of the sum of the longitudinal widths L1 and L2 of the two units, which is about 18.6 meters or more, is required. In comparison, the heating apparatus 20 shown in FIG. 3 permits the low and high temperature heating units 21 and 32 to be installed in separate places, dispensing with such a large linear space as no less than 18 meters as above-stated.

However, using the heating apparatus 20 shown in FIG. 2 permits the process to proceed to the next high temperature heating step 3 in the high temperature heating unit 31, without taking hangers off 30 after ending the low temperature heating step 2 in the low temperature heating unit 21, thus spares the trouble of resetting them. It is to note that while forming the low and high temperature heating units 21 and 31 as separate units, the conveyer arrangement may be arranged continuously through these units 21 and 31.

Figure 4:
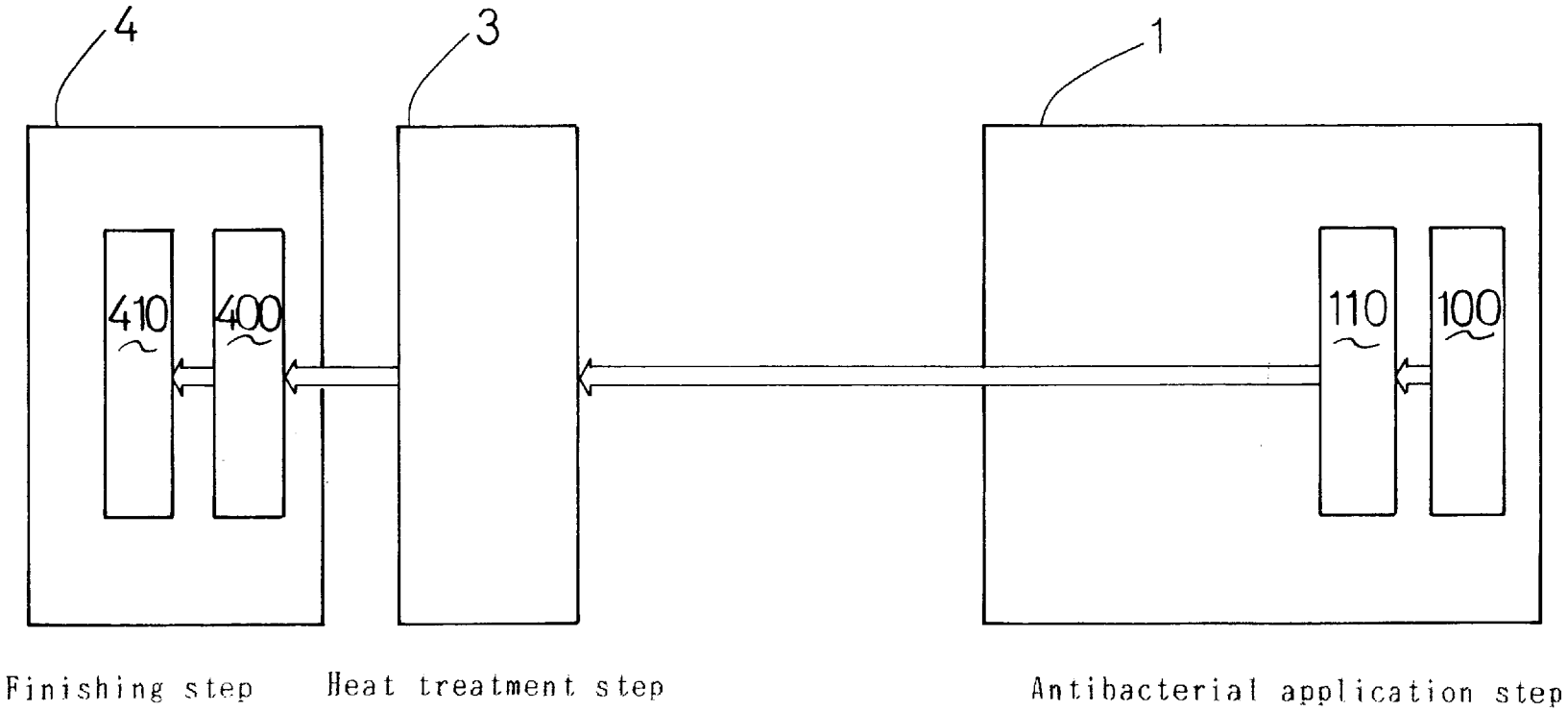
FIG. 4 is a block diagram showing another embodiment of the present invention.

With regard to the fungistatic/antibacterial process, further a third embodiment will now be described in reference to FIG. 4. FIG. 4 shows a block diagram representing the treatment process under the embodiment of this invention.

The fungistatic/antibacterial process under this embodiment comprises, as shown in FIG. 4, taking the fungistatic/antibacterial chemicals applying step 1, high temperature heating step 3 and the finishing step 4 on sewed clothes in the order mentioned.

This fungistatic/antibacterial applying step 1 comprises of primary dipping and primary extraction 110 performed after this primary dipping 100.

The aforementioned primary dipping 100, similarly as that under the embodiment shown in FIG. 1, is a process of throwing the clothes into a dipping tank filled with the fungistatic/antibacterial chemicals solution, to let the fungistatic/antibacterial chemicals solution permeate into the clothes. The primary extraction 110, similarly as that under the embodiment shown in FIG. 1, is a process in which the clothes taken out of the aforementioned dipping tank, after they have undergone the primary dipping 100, are extracted by the extractor. The extractor used is also identical to the one used under the embodiment shown in FIG. 1. The primary extraction 110 finally removes excess fungistatic/antibacterial chemicals solution from the clothes into which the fungistatic/antibacterial chemicals solution has been permeated, thereby promoting the adsorption of the fungistatic/antibacterial chemicals to its fibers. This embodiment should desirably be exercised in such a way that after accomplishing the primary extraction 110, the clothes should have a weight about twice as heavy as that before the fungistatic/antibacterial chemicals applying step 1.

Under this embodiment shown in FIG. 4, after the fungistatic/antibacterial applying step 1, the process proceeds directly to the high temperature heating step 3, without passing the low temperature heating step 2. The high temperature heating step 3 and the finishing step 4 performed thereafer are treatment steps of the same operations as those exercised under the embodiment of FIG. 1, It is proper to run the high temperature heating step 3 in the unit of FIG. 3(B).

The embodiment shown in FIG. 4 is similar to that shown in FIG. 1, except that the fungistatic/antibacterial chemicals applying step 1 is accomplished by the primary dipping 100and the primary extraction 110 only, and that the low temperature heating step 2 is not included.

By far the better adsorption rate of fungistatic/antibacterial chemicals is achieved onto the clothes after undergoing the fungistatic/antibacterial treatment when the secondary dipping and extraction 120 and 130 are performed after the primary dipping and extraction 100 and 110 in the fungistatic/antibacterial applying step 1, as under the embodiment shown in FIG. 1 than when they are not performed (as under the embodiment shown in FIG. 4). Accordingly, for enhancement of the adsorption rate of fungistatic/antibacterial chemicals, the secondary dipping and extraction 120 and 130 should desirably be performed, as under the embodiment shown in FIG. 1.

Although it is practical to operate the invention without taking the low temperature heating step 2, as under the embodiment shown in FIG. 4, going through the low temperature heating step 2 will lends itself to an attempt to retrench the treatment time of the high temperature heating step 3, thereby keeping low the heat energy required to be generated for the drying for the benefit of lower cost.

On the other hand, the embodiment of FIG. 4 wherein only the high temperature heating step 3 is performed, without taking the low temperature heating step 2, is more advantageous, where curtailment of the total time taken before ending the high temperature heating step 3 is concerned.

It is also appropriate to run the high temperature heating step 3 by making the hot air heating between 120 and 180° C. for about 2 to 8 minutes, depending on the material and quality of the clothes, even when the low temperature heating step 2 is omitted.

Figure 5:
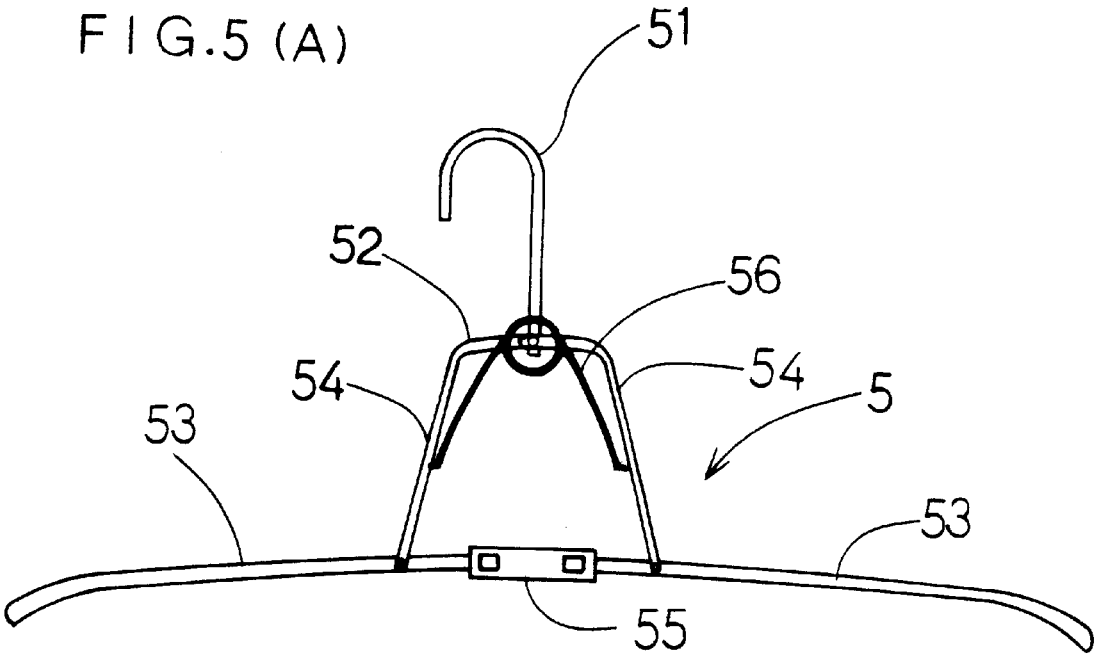
FIG. 5(A) is a front view of the hanger in its open state according to the present invention.
FIG. 5(B), a front view of the same in its closed state.
Figure 5:
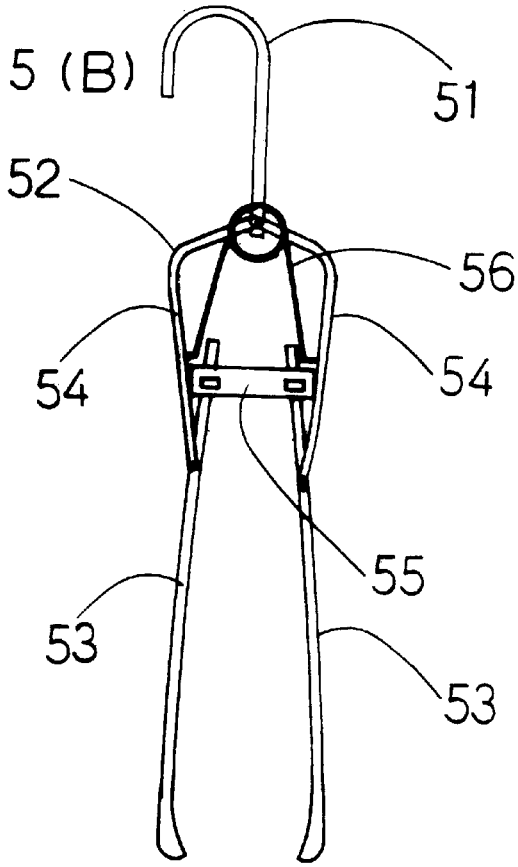

Next, a preferable configuration of the hanger 5 used for each conveyer arrangement will be described, referring to FIG. 5. The hanger of this example permits its arms to be folded when putting clothes there-on/off, thereby realizing very quick on/off of clothes. This hanger may be manufactured with appropriate materials with a condition that they have to withstand the heating temperature in each heating unit. In this example, stainless steel is used. This hanger 5 comprises a central portion 52 provided with a hook 51 and right and left arms 53 and 53 extending to the right and left from this central portion 52. This hook 51 is curved for it to be hitched on the conveyer chains 30 and 36*a*, but its particular configuration is appropriately alterable, only if it can be put on/off such conveyer means as conveyer chains 30 and 36*a* or the like. At the central portion is there provided a means for opening/closing the right and left arms 53 and 53. More particularly, the central portion 52 is configured of right and left grips 54 and 54 with their upper ends rotatably attached to the proximal end of the hook 51. These right and left grips 54 and 54 are rotatably connected to the arms 53 and 53 toward their proximal ends. The right and left arms 53 and 53 have proximal ends rotatably connected to a joint member 55, forming a link by the right and left grips 54 and 54, the right and left arms 53 and 53 and the joint member 55. Thus as shown in FIG. 5(B), bringing the right and left grips 54 and 54 near to each other by gripping the right and left grips 54 and 54 close the right and left arms 53 and 53. Between the right and left grips 54 and 54 is there arranged such a resilient body as a leaf spring 56 or the like, to normally bias the grips 54 and 54 in the direction of parting from each other, thereby to keep the right and left arms 53 and 53 open.

Figure 6:
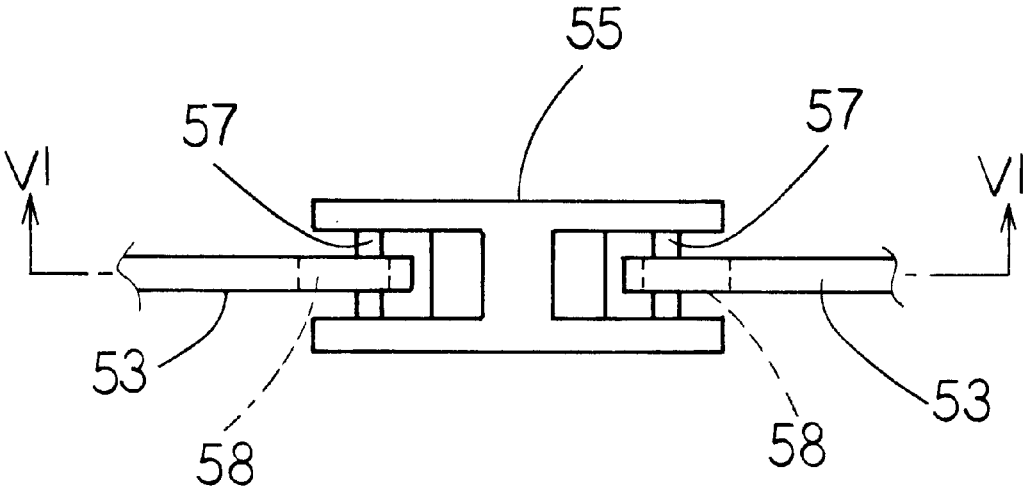
FIG. 6(A) is a plan view of the joint member of the hanger according to the present invention.
FIG. 6(B), its VI—VI line sectional view.
Figure 6:
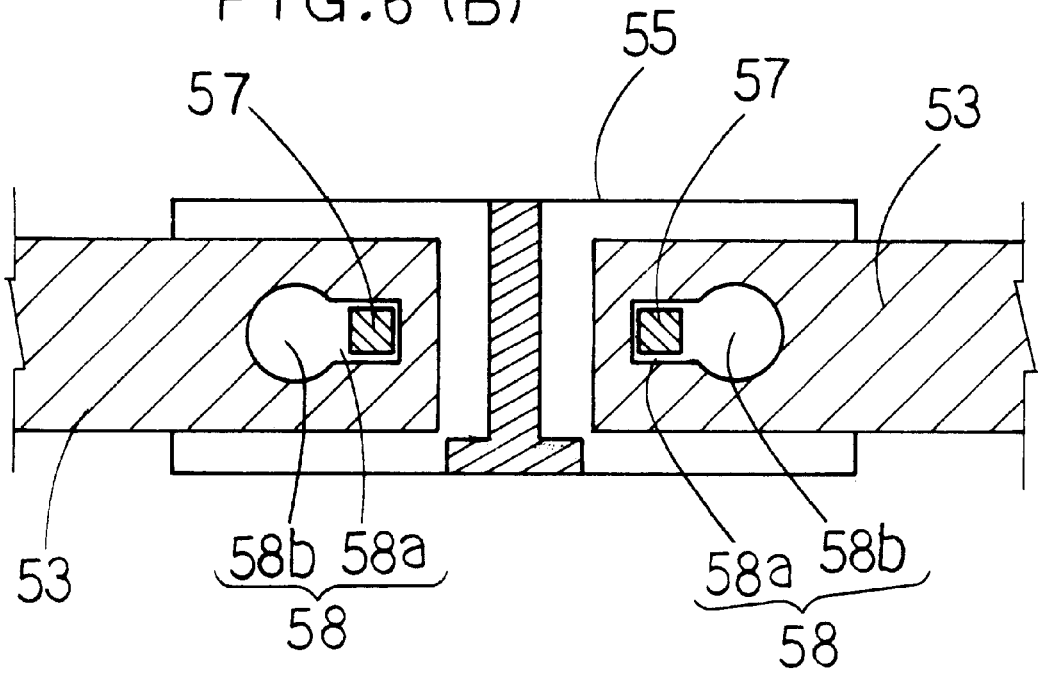

Further, in order to ensure maintaining the open state of the arms 53 and 53, the configuration of FIG. 6 is employed for the joint member 55. The joint member 55 is provided with joint pivot axes 57 and 57 for its connection with the arms 53 and 53, this connection permitting pivoting of the arms 53 and 53 thereabout, when closed, but not when open. In particular, in each of the arms 53 and 53 is there bored an axis insertion hole 58 through which to insert the pivot axes 57 and 57. This axis insertion hole 58 has two portions of unpivotable portion 58*a* and pivotable portion 58*b* which are contiguously formed. The unpivotable portion 58*a* engages with the joint pivot axis 57 to make the arms unrotatable about the joint pivot axis 57, while the pivotable portion 58*b* does not engage with the joint pivot axis 57, permitting their pivoting about the joint pivot axis 57. As shown in this view, the joint pivot axis 57 is formed rectangular in section, and the unpivotable portion 58*a* likewise rectangular, thereby restraining arm's pivoting, and the pivotable portion 58*b* is formed in the shape of a circle larger than the joint pivot axis 57, thereby permitting arm's pivoting. As an alternative, for example, the joint pivot axis 57 is formed in the shape of a notched circle in cross-section, and a part of unpivotable portion 58*a* is projected to engage with the notch, thereby providing a device to make them unrotatable. On the other hand, pivotable portion 58*b*, having no such projection, permits arm's free pivoting. Such other modifications are feasible. With the unpivotable portion 58*a* arranged on the distal end side of the pivotable portion 58*b*, the joint pivot axis 57 will be positioned in the unpivotable portion 58*a*, to make the arms 53 and 53 unpivotatable in their open state. As the grips 54 and 54 are gripped to bring them close to each other, the right and left arms 53 and 53 also come close to each other, and then the joint pivot axis 57 moves from the unpivotable portion 58*a* to the pivotable portion 58*b*, thereby making them pivotable. Further tightening the grips 54 and 54 to bring them more closer to each other results in further pivoting the arms 53 and 53 to close. To return them to their open state, release the gripping hand on the grips, and then the resilient body like 56 automatically return them to their former state, opening the arms 53 and 53 to be in the unpivotable state. Accordingly, when hanging clothes, the right and left arms 53 and 53 are inserted into the clothes in their state of being closed, thereafter releasing your hand from the grips 54 and 54, to open the right and left arms 53 and 53, thereby readily hanging the clothes from the hanger. When taking the clothes therefrom, this procedure is to be followed in the reverse order.

Next, the invention of this application is applicable to long strips like a woven label tape with one or more names stitched or printed on a cloth tape at a plurality of positions. The embodiment of this method is described as follows, referring to FIGS. 7 and 8.

Generally, the woven label is formed by stitching or printing one or more names on an oblong woven cloth at a plurality of positions in intermittent series, and is used by cutting it off name by name. Therefore, if the tape and the thread are separately subjected to the fungistatic/antibacterial treatment, many a treatment step and long treatment time will be required, but treating them in the state of a woven label tape on which the labeling work has been done at plurality of positions will permit the treatment to be performed efficiently. In this instance, the label may be one representing a trade mark or one giving such information as quality or washing method and so on.

Figure 7:
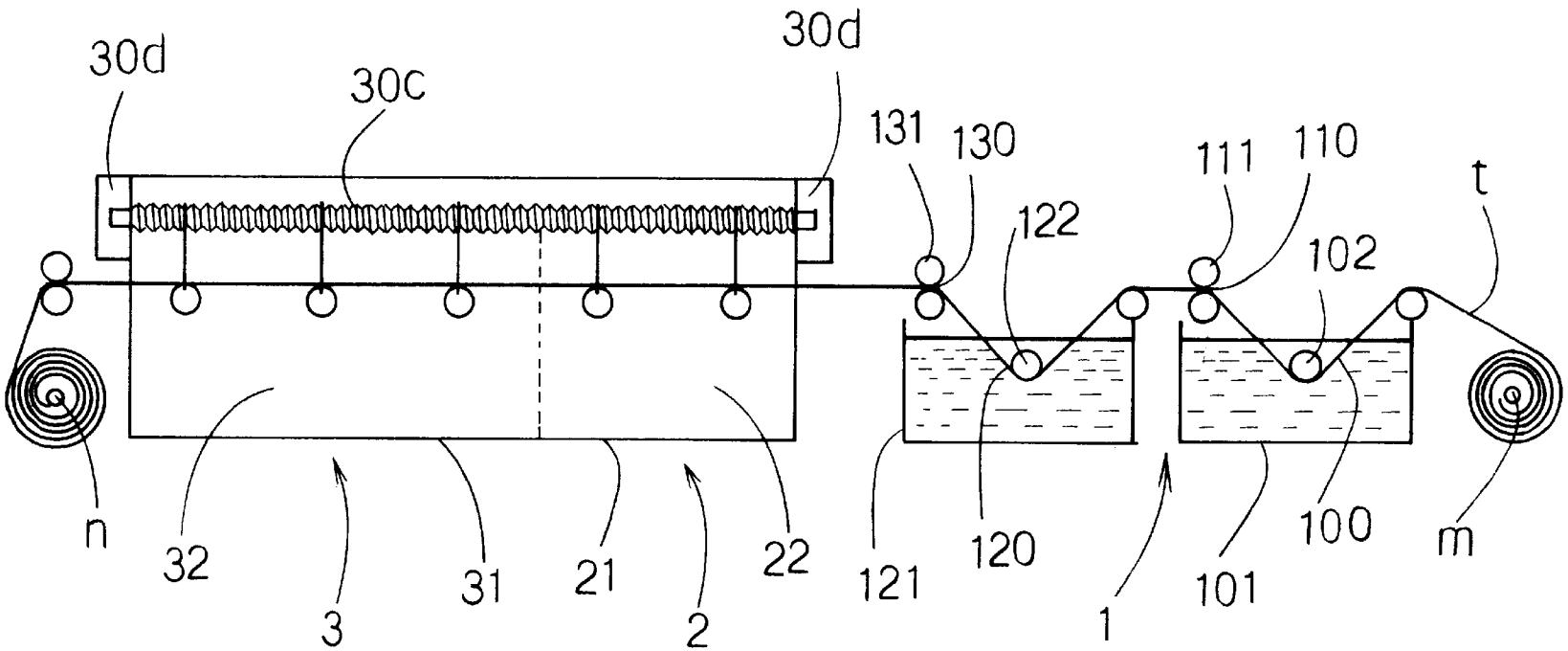
FIG. 7 is an explanatory diagram of the process showing still another embodiment of the present invention.

FIG. 7 is a schematic diagram portraying the total steps of this treating process. According to this example, a long strip t like a woven label tape, etc. formed by stitching the name on a length of woven cloth, which has been wound on a reel m, is reeled out to successively undergo the respective steps of the fungistatic/antibacterial chemicals applying step 1, low temperature heating step 2 and high temperature heating step 3, thereafter to be wound on a take-up roll n.

Similarly as in the first embodiment, the fungistatic/antibacterial chemicals applying step 1 comprises primary dipping 100 and primary wringing 110 which is performed after the primary dipping 100, and secondary dipping 120 which is performed after the primary wringing 110 and secondary wringing 130 which is performed after the secondary dipping 120. The primary and secondary dipping 100 and 120 are performed by letting the long strip traverse the primary and secondary dipping tanks 101 and 121, while submerging it in the fungistatic/antibacterial chemicals solution which is filled therein. For dipping the long strip t in this manner, it is only proper to guide it through the fungistatic/antibacterial chemicals solution by the aid of guide rollers 102 and 122. As the fungistatic/antibacterial chemicals solution, similar one as used under the previous embodiment may be utilized.

The primary and the secondary wringing 110 and 130 is a process of draining excess fungistatic/antibacterial chemicals solution by wringing the long strip by wringers. According to this example, with primary and secondary wringing rollers 111 and 131 arranged in proximity to the exits of the primary and secondary dipping tanks, respectively, the long strip is passed between the wringing rollers 111 and 131, thereby squeezing it off.

It is to note that this process may be operated with the secondary dipping and wringing omitted, similarly as in the previous example. Alternately, it is also practical to run it by dipping the reeled out long strip in the solution only once, using the same apparatus as used under the previous embodiment, followed by draining by centrifuge, instead of continuously treating the reeled out long strip.

Next, the low and high temperature heating steps 2 and 3 make use of a heating apparatus comprising similar heater housings 22 and 32 as those used under the first embodiment. Thus it comprises a low temperature heating unit 21 for performing the low temperature heating step 2, a high temperature heating unit 31 for performing the high temperature heating step 3, and a conveyer arrangement 30 installed inside the low and high temperature heating units 21 and 31. For the conveyer arrangement 30, the conveyer chain may be used, but a conveying rod shape screw is employed under this embodiment. This conveying rod shape screw 30c is so arranged as to pass the inside of the low temperature heater housing 22 through the high temperature heater housing 32, and with both ends thereof rotatably supported by bearings 30d, it is turned by a rotary drive means (not shown in this drawing) like motor, etc.

Mounted on this rod shape conveyer screw 30c are long strip support 6 for holding the long strip, to have this long strip support 6 guide the long strip t. However, so far as the feeding of the long strip t is concerned, this rod shape conveyer screw 30*c* does not operate, but functions merely to have the long strip support 6 mounted thereon.

Figure 8:
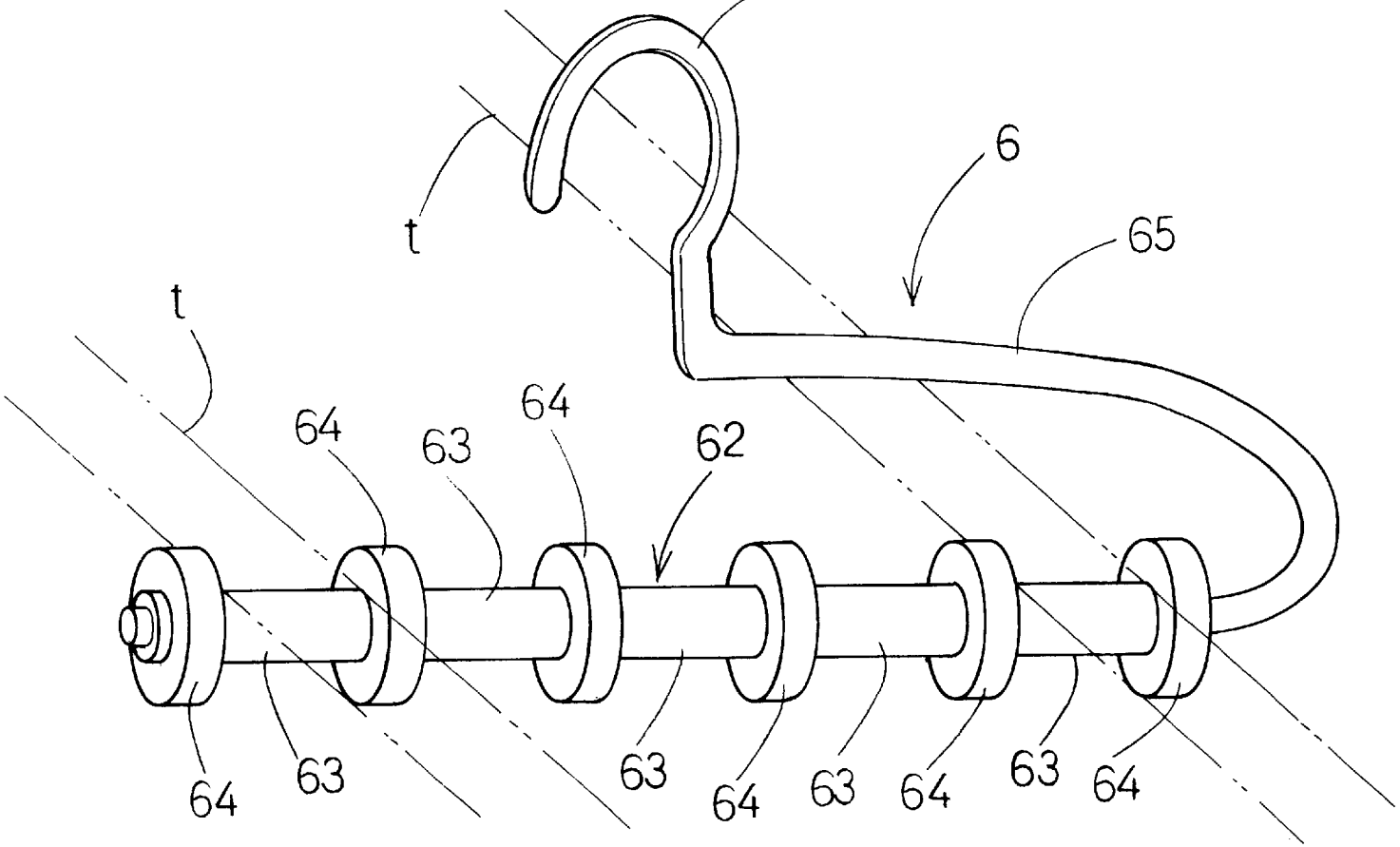
FIG. 8 is a perspective view of a long strip support covered by said embodiment.

Referring now to FIG. 8, the long strip support 6 will be described more in detail. This long strip support 6 comprises a hook 61 which is hitched over a conveyer means like the rod shape conveyer screw 30*c*, etc. and a guide 62 held by this hook 61. The guide 62 is provided with appropriate guide roller segments 63, such that the long strip t may be guided by this guide roller segment 63 while being supported thereby. Between each two of the guide roller segments 63 is there arranged a side guide 64 for prevention of side shift of the long strip t. In this example, with one end of the guide 62 connected with the hook 61 through a link 65, the long strip t is permitted to be loaded on the guide roller segment 63 from one side, but like the ordinary hanger, it may be arranged such that both ends of the guide 62 may be connected to the hook 61 through right and left link 65. Alternately, with the hook 61 extended upward from the center of the guide 62, forming an inverted T between them, to arrange the guide roller segments 63 divided in half on both sides of the hook 61.

The long strip supports 6 may be mounted on a resting rod shape conveyer screw 30*c* by hitching them thereover at predetermine intervals. They may be mounted at the specified positions by the operator who has brought them with him thereto. However, the long strip support 6 may be arranged more efficiently by operating the conveyer means to mount the long strip supports 6 one by one by way of hitching, etc. over the rod shape conveyer screw 30*c* at appropriate intervals while he is at a predetermined site such as the entrance to the low temperature heating step 2, etc, and then stopping the rotary drive of the rod shape conveyer screw 30*c* with the long strip supports being arranged thereon at appropriate intervals in the heater housing. In this manner, the low and high heating units 21 and 31 used for clothes may be utilized as they are for long strips merely by replacing the hangers with the long strip supports 6. It goes without saying that if this system is operated for exclusive use with long strips, the long strip supports 6 may be directly installed at appropriate positions inside the heater housing without providing the conveyer means. As an alternative, the long strip t may be fed while being spanned between the guide roller segments arranged beforehand not inside but outside of the heater housings 22 and 32. Whichever the case, by moving the long strip t in the state of being arranged in the air space of the heater housing, they may be efficiently heated uniformly all over along its length.

It is to note that according to this example, the heater housings covered by the first embodiment has been used, but those covered by the second embodiment may be utilized. Then even when the lowand high heating units 21 and 31 are separately installed, it will be more efficient to feed the long strip continuously. However, the system may be operated with each steps separated by taking up the long strip at appropriate sections among the fungistatic/antibacterial chemicals applying step 1, and the low and high heating steps 2 and 3 or such other procedures. Furthermore, with regard to the alternatives as shown in the embodiment previously described, the system may be operated with their combination with any of the respective embodiment within the range not departing from the spirit of the invention covered by the appended claims.

The first invention of this application has made it possible to provide a method of foreclosing uneven permeation of chemicals, which was formerly unavoidable, with sewed goods like clothes to which the fungistatic/antibacterial chemicals have been applied after they had been sewed, thereby not only permitting the fungistatic/antibacterial chemicals to be uniformly applied to the texture of sewed goods like clothes, but the effect of the treatment to pervade every nooks and crannies of the sewed goods including sewing thread, fastener, button and so on, with the effect lasting even after 100 times washing.

In addition to the effect of the aforementioned first invention, the second invention of this application has made it possible to provide a method capable of ensuring more positive and uniform adsorption of the chemicals to clothes, thereby preventing their fungistatic/antibacterial effect from diminishing even by frequent washing.

In addition to the effects of the aforementioned first and second invention, the third invention of this application has made it possible to provide a method that permits the clothes to be efficiently hung from and taken off the hanger, with a facility afforded by the opening/closing of the hanger's arms.

In addition to the aforementioned respective inventions, the fourth invention of this application has made it possible to provide a method that permits favorable drying by heating to be realized, thereby enhancing the rate of adsorption of the fungistatic/antibacterial chemicals by performing the treatment process in two steps at low and high temperatures, respectively.

In addition to the effects of the aforementioned respective first, second and fourth inventions, the fifth invention of this application also has made it possible to provide a method of making the fungistatic/antibacterial treatment more efficiently than by separately subjecting cloth tape and thread for name stitching, where intermediary products like woven label tapes are concerned.

In addition to the effect of the aforementioned fifth invention, the sixth invention of this application has made it possible to provide a method that permits change to be made between the process for ordinary clothes and that for long strips.

In addition to the effects of the aforementioned respective first, second and fourth inventions, the seventh invention of this application has made it possible to provide a method that enables the fungistatic/antibacterial treatment to be performed efficiently on such intermediary products like woven label tapes rather than separately subjecting cloth tape and the thread for stitching name or the printing ink to the fungistatic/antibacterial process.

The eighth invention of this application has made it possible to provide a system for fungistatic/antibacterial process that enables foreclosing the uneven permeation of the fungistatic/antibacterial chemicals onto sewed goods that has hitherto inevitably been brought about by their contact with other objects.

We claim:

1. A fungistatic/antibacterial treatment method comprising a fungistatic/antibacterial chemicals applying step of depositing or permeating fungistatic/antibacterial chemicals on or into finished sewed goods like clothes after sewed, and then a heating treatment step of heating said sewed goods arranged in the air, thereby fixedly setting the fungistatic/antibacterial chemicals to the sewed goods, wherein the fungistatic/antibacterial chemicals applying step further comprises:

a primary dipping wherein the sewed goods are dipped in the fungistatic/antibacterial chemicals, a primary extraction wherein the sewed goods which have undergone the primary dipping are allowed to drain excess chemicals, a secondary dipping wherein the sewed goods are again dipped in the fungistatic/antibacterial chemicals after the primary extraction, and a secondary extraction wherein the sewed goods which have undergone the secondary dipping are allowed to drain excess chemicals, wherein the heating treatment step further comprises heating the sewed goods by moving the sewed goods in a heater housing wherein the sewed goods are hung from hangers, said hangers being held by a conveyer means that transfers the objects to move, passing at least through the heater housing, wherein the hanger comprises a central portion provided with a hook, right and left arms extending right- and left-ward therefrom, and an opening/closing means for opening/closing the right and left arms, the sewed goods to be hung from the hanger, with the right and left arms opened, after inserting the right and left arms into the sewed goods with the right and left arms closed, and wherein the heating treatment step further comprises a low temperature heating step at a temperature between about 70° C. and 80° C. and a high temperature heating step at a temperature between about 120° C. and 180° C. in which the heating is made at a higher temperature than in the low temperature heating step, the sewed goods to be heated by continuously moving the sewed goods from a low temperature heater housing for use in the low temperature heating step through a high temperature heater housing for use in the high temperature heating step.

2. A fungistatic/antibacterial treatment installation comprising a fungistatic/antibacterial chemicals applying means with which to deposit or permeate the fungistatic/antibacterial chemicals on or into finished sewed goods like clothes after sewed, and a heating treatment means for heating the sewed goods to which the fungistatic/antibacterial chemicals have been applied and which is in the state of being arranged in the air, wherein said applying means comprises:

a primary dipping comprising dipping the sewed goods in the fungistatic/antibacterial chemicals, a primary extraction wherein the sewed goods which have undergone the primary dipping are allowed to drain excess chemicals, a secondary dipping wherein the sewed goods, which have undergone the primary extraction, are again dipped in the fungistatic/antibacterial chemicals, and a secondary extraction wherein the sewed goods, which have undergone the secondary dipping, are allowed to drain excess chemicals, wherein the heating treatment step further comprises heating the sewed goods by moving the sewed goods in a heater housing wherein the sewed goods are hung from hangers, said hangers being held by a conveyer means that transfers the objects to move, passing at least through the heater housing, wherein the hanger comprises a central portion provided with a hook, right and left arms extending right- and left-ward therefrom, and an opening/closing means for opening/closing the right and left arms, the sewed goods to be hung from the hanger, with the right and left arms opened, after inserting the right and left arms into the sewed goods with the right and left arms closed, and wherein the heating treatment means further comprises a low temperature heating means at a temperature between about 70° C. and 80° C. and a high temperature heating means at a temperature between about 120° C. and 180° C. in which the heating is made at a higher temperature than in the low temperature heating, the sewed goods to be heated by continuously moving the sewed goods from a low temperature heater housing for use in the low temperature heating means through a high temperature heater housing for use in the high temperature heating means.

* * * * *